United States Patent [19]

Johnson

[11] Patent Number: 4,516,515

[45] Date of Patent: May 14, 1985

[54] BOAT PLUG REMINDER AND METHOD FOR USE THEREOF

[75] Inventor: David A. Johnson, Salem, Oreg.

[73] Assignee: J.F.S., Inc., Salem, Oreg.

[21] Appl. No.: 496,172

[22] Filed: May 19, 1983

[51] Int. Cl.[3] ..... B63B 13/00

[52] U.S. Cl. ..... 114/197; 116/28 R

[58] Field of Search ..... 114/182, 197, 198, 344; 116/28 R, 175, 307

[56] References Cited

U.S. PATENT DOCUMENTS 3,812,810 5/1974 Moeller ..... 114/197

4,010,967 3/1977 Renteria ..... 116/28 R

*Primary Examiner*—Galen L. Barefoot

*Assistant Examiner*—Jesûs D. Sotelo

*Attorney, Agent, or Firm*—Chernoff, Vilhauer, McClung, Birdwell & Stenzel

[57] ABSTRACT

A device and method for its use for storage of a boat plug when it has been removed from the drain hole in the bottom of a boat in such a way as to remind the boat user to replace the boat plug in the drain hole before launching the boat, and to remove the boat plug from the drain hole to permit drainage of the boat when the boat is out of water. A boat plug storage receptacle may be attached to the boat, and a reminder flag may be attached to the receptacle by installation of the boat plug in the receptacle. A flexible connecting member is used to connect the reminder flag to a portion of apparatus such as a boat trailer used to support the boat while it is out of water, preferably connecting the flag to a portion of the supporting apparatus which must be disconnected from the boat before the boat can be launched or otherwise removed from the supporting apparatus. Removal of the connecting member from the boat requires loosening of the boat plug from the storage receptacle.

11 Claims, 5 Drawing Figures

BOAT PLUG REMINDER AND METHOD FOR USE THEREOF

TECHNICAL FIELD

The present invention relates to boat plugs and particularly to a device and the method for its use for reminding one to install or remove a boat plug at an appropriate time.

BACKGROUND OF THE INVENTION

Boats normally include drain holes located below the waterline, and usually in the lowest part of the hull, to permit drainage of bilge water when the boat is removed from the water for transport or storage. When such a boat plug is not properly installed, water can fill and sink the boat by entering the bottom of the boat through the drain hole.

It is at least embarrassing, and potentially quite costly to launch a boat without such a boat plug being properly installed. It is quite likely that a boat plug can be misplaced, or be stored in a boat in a location not within quick or easy reach of the drain hole. In order to prevent this occurrence some boat plugs have been fastened to the interior of the boat at a location near the drain hole, but this has not always acted as a reminder to install the boat plug before launching the boat nor to remove the boat plug to permit drainage of the boat upon its removal from the water. Additionally, even though a boat plug is readily available near the drain hole, the inward pressure of water resulting from the location of the drain hole at some distance below the surface of the water in which a boat is floating hampers installation of a boat plug.

While there is little risk of a boat sinking upon launching if the plug has been left in the drainhole when the boat is out of water, the boat plug should be removed when the boat is out of water to prevent damage to the interior of the boat. For example, a boat, if left uncovered and unattended, can fill with rain to a level which might damage electrical equipment, promote mildew and rot in the boat or its contents, or result in structural damage should the water freeze.

In order to prevent the risk of sinking a boat upon launching and to prevent damage to a boat or its contents when the boat is out of the water, it is desirable to provide a device for reminding a boat owner to install or remove the boat plug from the boat drain hole at the appropriate times.

SUMMARY OF THE INVENTION

In order to meet the previously unanswered need for a simple, reliable device to remind a boat owner to install or remove a boat plug at the appropriate times, present invention provides a storage receptable for holding a boat plug securely at the times when the boat is out of the water. Combined with the receptacle is a reminder element which is retained in the storage receptacle by the boat plug itself when the boat plug is not installed in a boat drain hole. The remainder element is connected by a chain or the like to a portion of a boat trailer or other apparatus used as support for the boat when it is out of water, so that loosening the boat from the device on which it is supported out of water requires the boat plug to be at least loosened from the receptacle. The device of the invention thus acts as a reminder of the necessity to install the boat plug in a drain hole before launching the boat.

In a first embodiment of the invention, a boat plug storage receptacle includes a threaded bore to receive a common type of boat plug which is essentially similar to a pipe plug. A reminder flag fits into a channel provided in the boat plug storage receptacle and is only prevented from falling from the channel by screwing the boat plug fully into the receptacle. A chain or the like is used to connect the reminder flag to a detachable portion, such as a hold-down strap, of a boat trailer.

In a second embodiment of the invention, a boat plug storage receptacle includes a sleeve to receive another type of boat plug, and the reminder flag is in the form of a collar which fits around the boat plug and may only be removed from the boat plug after it has been removed from the receptacle. The collar is also connected to a portion of a boat trailer or other out-of-water support for the boat by a chain or the like.

It is therefore a principal objective of the present invention to provide a device for securely holding a boat plug in an accessible position in which the boat plug forms a part of the connection of the boat to apparatus used to support the boat out of water.

It is another important objective of the invention to provide a method for reminding a boat user to install a boat plug in a boat drain hole before launching the boat.

It is an important feature of the present invention that a connection between a boat and apparatus supporting the boat when the boat is out of water may only be disconnected from the boat by loosening the boat plug from a storage receptacle.

It is another important feature of the present invention that it includes a clearly apparent reminder flag connected to apparatus used to support the boat out of water, so as to remind the user to remove and properly store the boat plug.

It is an important advantage of the present invention that its use reduces the likelihood of damage and embarrassment which were previously the result of forgetting the boat plug.

The foregoing and other objectives, features and advantages of the invention will be more readily understood upon consideration of the following detailed description of the invention, taken in conjunction with the accompanying drawings.

DETAILED DESCRIPTION OF THE INVENTION

Figure 1:
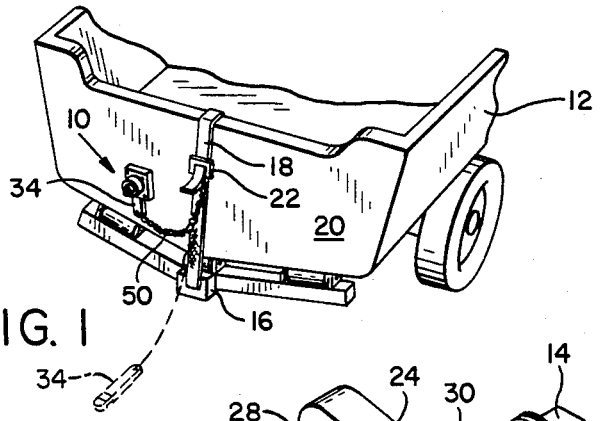
FIG. 1 is a perspective view of a boat plug storage and reminder device embodying the present invention in use in connection with a boat and trailer.

Referring now to drawings, the boat plug reminder apparatus 10 of the present invention is shown in FIG.

1 being used on a boat 12 to store a boat plug 14 while the boat 12 is being carried on a boat trailer 16. The boat plug 14 is of the type which is similar to a pipe plug, including a threaded body and a head which can be engaged by a wrench. A hold-down strap 18 extends upward from a frame member of the trailer 16 and is attached to the transom 20 of the boat 12. A buckle 22 of the hold-down strap 18 permits the strap to be tightened to hold the boat 12 tightly onto the trailer 16 during transit.

Figure 2:
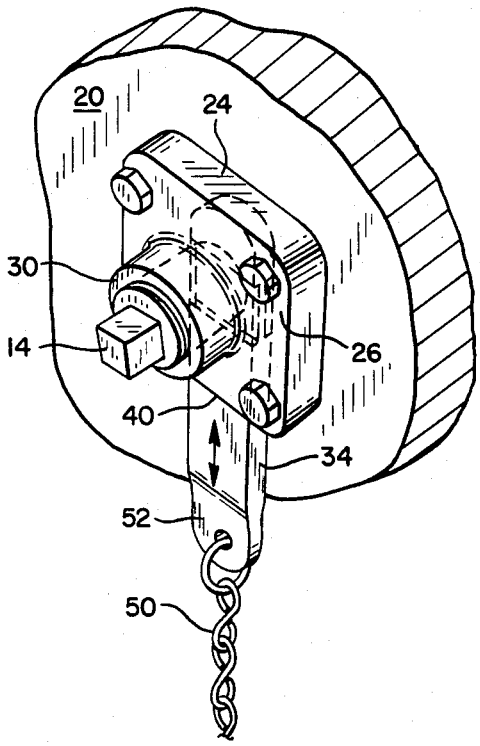
FIG. 2 is a perspective view of the boat plug storage and reminder device shown in FIG. 1, at an enlarged scale.
Figure 3:
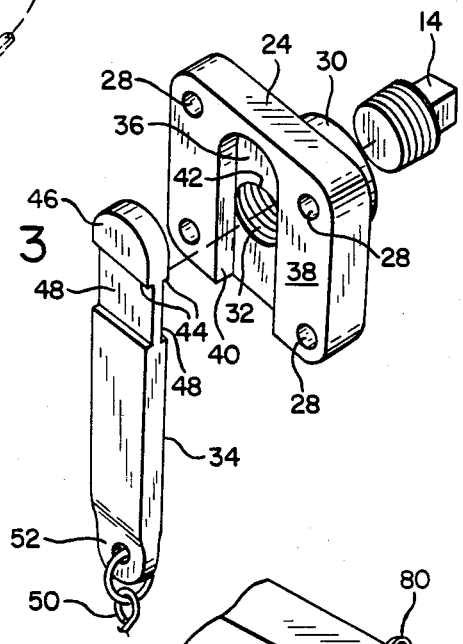
FIG. 3 is an exploded perspective view of the rear side of the boat plug storage and reminder device shown in FIG. 1, at an enlarged scale.

Referring now also to FIGS. 2 and 3, the boat plug storage and reminder apparatus 10 includes a body 24 having a base flange 26 which is square in shape and which includes mounting screw holes 28 located in its corners to permit the body 24 to be fastened to the transom 20. The body 24 may be made of any suitably strong material which will not react chemically with the common materials used for a boat plug 14, such as an injection-moldable plastics material.

A boss 30 is centrally located on the front side of the body 24 and includes a threaded bore 32. A reminder flag 34 fits within a cavity such as a channel 36, which is defined in a back side 38 of the body 24 and is downwardly open through the bottom 40 of the body 24. An inner end 42 of the threaded bore 32 opens into the channel 36, which extends both above and below the threaded bore 32.

The reminder flag 34 is, for example, an enlongated strip including at least one shoulder 44 defining a head end portion 46 which is raised with respect to a central portion 48. The reminder flag 34 may be made of brightly colored plastic, in order to visually attract attention, or it may be made of metal which may produce an audible ringing sound if it is dragged along the ground.

The channel 36 is at least as deep as the thickness of the reminder flag 34, so that when the body 24 is securely attached against a flat surface such as that of the transom 20 of the boat 12, there is enough clearance for the reminder flag 34 to be inserted upwardly into the channel 36. The central portion 48 may be aligned with the threaded bore 32, which is smaller than the central portion 48, so that the boat plug 14 may be screwed far enough through the threaded bore 32 to bear against the central portion 48,.engaging the reminder flag 34 below the shoulder 44, which acts as a retainer to hold the reminder flag 34 within the channel 36 so long as the boat plug 14 is not loosened from such a position within the threaded bore 32.

A connecting chain 50 is permanently attached to a tail end 52 of the reminder flag 34. The connecting chain 50 is at least long enough to extend from the buckle 22 to the reminder flag 34 when the hold down strap 18 is being used to hold the boat 12 in place on the trailer 16 and the reminder flag 23 is held in position in the channel 36 by the boat plug 14. Preferably, the connecting chain 50 is also long enough to allow the reminder flag 34 to reach to the ground from the buckle 22 if the reminder flag 34 is not located within the channel 36, in order to attract attention and remind one to remove the drain plug 14 from the drain hole.

Figure 4:
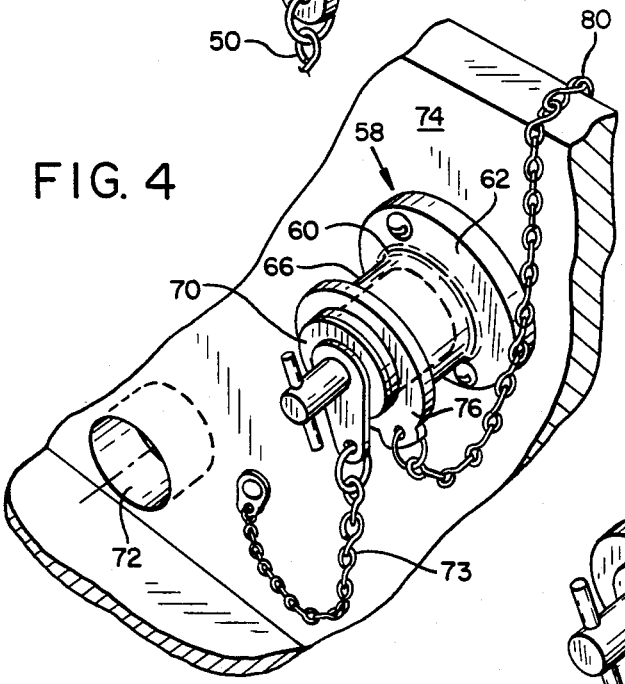
FIG. 4 is a perspective view of an alternative boat plug storage and reminder device embodying the present invention in use in connection with a boat.
Figure 5:
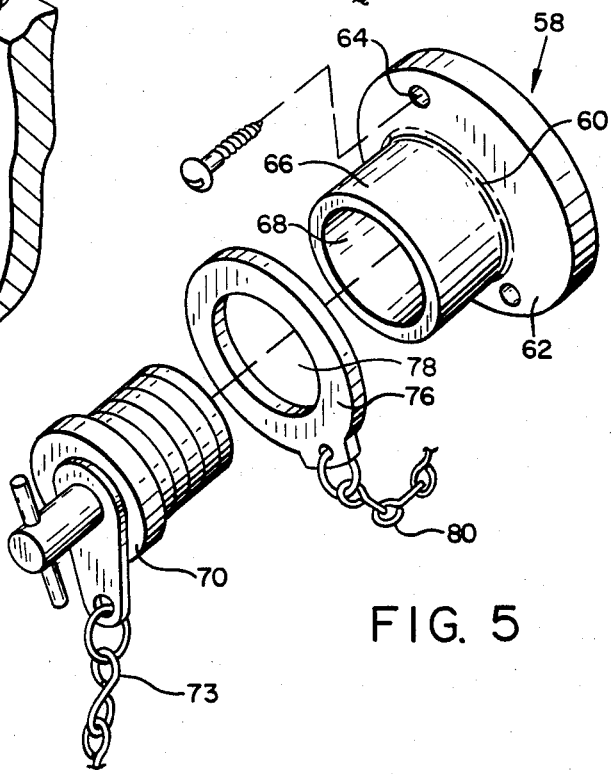
FIG. 5 is an exploded view of the boat plug storage and reminder device shown in FIG. 4, at an enlarged scale.

A boat plug storage and reminder receptacle 58, shown in FIGS. 4 and 5, which is an alternative embodiment of the present invention includes a body 60 having a base flange 62 defining screw holes 64 to permit the body 60 to be mounted with the base flange 62 resting against an appropriate flat surface of a boat. A receptacle sleeve 66 extends outwardly from the base flange 62 and includes a cylindrical central bore 68, of an appropriate size to receive a boat plug 70. The boat plug 70 is of the type including a cylindrical rubber seal member and a bolt and nut combination used to axially compress the rubber cylinder between a pair of end plates to expand it radially against the inner surfaces of the drain hole 72 of a boat. Boat plugs such as the boat plug 70 are found in smaller recreational boats and commonly are attached to the hull of a boat by a short keeper chain 73. For that reason the body 60 of the boat plug storage and reminder apparatus 58 will normally have to be mounted on a readily accessable interior surface 74 of such a boat.

A reminder flag 76 consists of a flat washer-like collar defining a central opening 78 of the same diameter as the central bore 68 of the receptacle sleeve 66. The reminder flag 76 may also be of either metal or brightly colored material in order to attract attention when necessary. Attached to the reminder flag 76 is a connector chain 80, which, like the connector chain 50, is long enough to reach from the boat plug storage and reminder receptacle 58 to a portion of a boat trailer or other support structure used to hold the boat. As with the boat 12, a preferable attachment point for the other end of the connector chain 80 is the buckle on a hold-down strap used to hold such a boat on a trailer or other supporting device from which the boat might be launched. Additionally, as with the connector chain 50, the connector chain 80 should be long enough to permit the reminder flag 76 to reach the ground if the boat plug has not been properly stored in the sleeve 66.

The apparatus of the present invention, in either of the two alternative forms described above, is used in accordance with the method of the invention to remind a person launching or hauling out the boat with which the device is used to place the boat plug in the appropriate location to permit drainage of the boat when it is ashore or aboard ship, or to prevent the boat from taking on water and sinking when launched. When removing the boat 12 from the water and placing it on the trailer 16, the hold-down strap 18 will ordinarily be used to hold the boat 12 securely on the trailer for transit. Since the connector chain 50 is attached to the buckle 22, the reminder flag 34 will attract the attention of the person installing the hold-down strap 18, thus reminding that person to remove the boat plug 14 from the drain hole in the bottom of the boat 12. The boat plug 14 may then be screwed into the threaded bore 32 part way. The reminder flag 34 is inserted upwardly into the channel 36, until the shoulder 44 has passed beyond the inner end 40 of the threaded bore 32, and the boat plug 14 may then be screwed into the threaded bore 32 until the boat plug 14 presses against the central portion 48 of the reminder flag 34, retaining the reminder flag 34 within the channel 36 and thus keeping the connector chain 50 from dragging on the ground. Ordinarily the boat plug 14 will be screwed into the threaded bore 32 far enough, and the threads of the threaded bore 32 will grip the boat plug 14 tightly enough, to prevent the boat plug 14 from backing out. However, should the boat plug 14 begin to back out from the threaded bore 32 the reminder flag 34 will drop out of the channel 36 and attract the attention of the operator of the vehicle towing the trailer 16 in time to prevent loss of the boat plug 14.

In preparing to launch the boat 12 it will be necessary to remove the hold-down strap 18 from its location attached to the transom 20 of the boat 12. It will be impossible, however, to disconnect the hold down strap 18 completely from the boat 12 until the boat plug 14 is loosened from its position holding the reminder flag 34 within the channel 36. This will act as a reminder to the person preparing to launch the boat 12 to fully remove the boat plug 14 from the boat plug storage and reminder device 10, and to install the boat plug 14 in its proper location in the drain hole of the boat 12. Once this has been done the hold-down strap 18 may be removed from the trailer and stored in its normal storage position while the trailer 16 is moved without the boat 12.

Use of the boat plug storage and reminder device 58 is essentially similar, although, because of the usual location of the device within the hull of the boat, there is no danger of losing the boat plug 70 during transit. For that reason, complete removal of the boat plug 70 from the receptacle sleeve 66 is required to remove the reminder flag 76 to free the boat from the trailer or other device on which the boat is being supported out of the water. When the boat plug 70 has thus been fully removed from the retainer sleeve 66 it will be obvious to install it in the drain hole 72.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A device for reminding a person to install a boat plug in a boat before launching the boat and to remove the boat plug upon removing the boat from water, comprising:

(a) a boat plug storage receptacle adapted for mounting on a boat;

(b) connecting means removably attachable to said boat plug storage receptacle, for extending from said boat plug storage receptacle to a connection point on apparatus used to support a boat on which said boat plug storage receptacle is mounted, when said boat is out of water;

(c) a reminder flag, associated with said connecting means; and (d) cooperative attachment means included in said boat plug storage receptacle and said connecting means, for utilizing a boat plug installed in said boat plug storage receptacle to attach said connecting means to said boat plug storage receptacle and requiring loosening of said boat plug from said boat plug storage receptacle in order to detach said connecting means from said boat plug storage receptacle.

2. The device of claim 1, wherein said reminder flag includes means for attracting attention thereto when said connecting means is not attached to said boat plug receptacle.

3. The device of claim 2, wherein said means for attracting attention comprises a brightly colored member included in said reminder flag.

4. The device of claim 2 wherein said connecting means is flexible and long enough to permit said reminder flag to reach the ground when said connecting means is not attached to said boat plug storage receptacle.

5. The device of claim 2, wherein said means for attracting attention includes means for making noise when said boat is transported without said connecting means attached to said storage receptacle by presence of said boat plug in said storage receptacle.

6. The device of claim 1, wherein said connecting means includes collar means adapted to fit around a boat plug when the boat plug is installed in said boat plug receptacle, said collar means including said reminder flag.

7. The device of claim 1, wherein said boat plug receptacle includes means defining a cavity, for receiving a portion of said reminder flag and wherein said reminder flag includes retainer means for holding said portion of said reminder flag in said cavity when said boat plug is installed in said receptacle and preventing removal of said reminder flag from said cavity when said boat plug is installed in said receptacle with said portion of said boat plug received within said retainer means.

8. The device of claim 7, wherein said receptacle includes a threaded bore having an inner end and said cavity is a channel extending across said inner end of said threaded bore.

9. A method for reminding a boat user to replace a boat plug in a drain hole of a boat before launching the boat, comprising:

(a) mounting a storage receptacle for a boat plug on in a boat;

(b) connecting a reminder flag movably to a portion of an apparatus used to support the boat while it is out of the water;

(d) attaching said reminder flag to said storage receptacle by installing the boat plug of the boat in the storage receptacle in a manner which requires the boat plug to be at least loosened therefrom in order to detach the reminder flag from the storage receptacle.

10. The method of claim 9 including, in step (b) thereof, an elongate flexible connecting member between the reminder flag and the apparatus used to support the boat out of water.

11. The method of claim 10 including connecting said elongate flexible connecting member to a portion of the apparatus used to support the boat out of water which must be released from the boat to permit the boat to be launched.

* * * * *

UNITED STATES PATENT AND TRADEMARK OFFICE

CERTIFICATE OF CORRECTION

PATENT NO. : 4,516,515

DATED : May 14, 1985

INVENTOR(S) : David A. Johnson

It is certified that error appears in the above-identified patent and that said Letters Patent is hereby corrected as shown below:

At Col. 1, line 62, change "remainder" to read --reminder--.

Signed and Sealed this

*Fourteenth* Day of *January 1986*

[SEAL]

*Attest:*

DONALD J. QUIGG

*Attesting Officer*

*Commissioner of Patents and Trademarks*